US010052633B2

(12) United States Patent
Kantor et al.

(10) Patent No.: US 10,052,633 B2
(45) Date of Patent: Aug. 21, 2018

(54) CUSTOMIZABLE STACKABLE RACK FOR VIALS AND TEST TUBES

(71) Applicant: RACK ON INC., Palo Alto, CA (US)

(72) Inventors: Johanna Kantor, Palo Alto, CA (US); William F. Stewart, Half Moon Bay, CA (US)

(73) Assignee: RACK ON INC., Palo Alto, CA (US)

( * ) Notice: Subject to any disclaimer, the term of this patent is extended or adjusted under 35 U.S.C. 154(b) by 0 days.

(21) Appl. No.: 15/593,101

(22) Filed: May 11, 2017

(65) Prior Publication Data

US 2017/0361325 A1 Dec. 21, 2017

Related U.S. Application Data

(60) Provisional application No. 62/350,609, filed on Jun. 15, 2016.

(51) Int. Cl.

| | |
|---|---|
| ***A47B 73/00*** | (2006.01) |
| ***A47F 7/00*** | (2006.01) |
| ***A47G 29/00*** | (2006.01) |
| ***B01L 9/06*** | (2006.01) |

(52) U.S. Cl.

CPC ..... *B01L 9/06* (2013.01); *B01L 2200/18* (2013.01); *B01L 2300/021* (2013.01); *B01L 2300/043* (2013.01); *B01L 2300/1822* (2013.01); *B01L 2300/1855* (2013.01); *B01L 2300/1894* (2013.01)

(58) Field of Classification Search

CPC .. B01L 9/06; B01L 2200/087; B01L 2200/18; B01L 2300/02; B01L 2300/021; B01L 2300/04; B01L 2300/043; B01L 2300/0609; B01L 2300/18; A47B 73/00; A47F 7/28; A47F 7/283; A47G 23/02; A61B 50/20; A61B 50/22

USPC .... 211/74, 188, 85.18, 85.13; 206/562, 564, 206/370, 363, 443, 569, 508, 509, 511; 220/507, 513, 810, 831, 832, 835, 560.12, 220/495.01; D24/227, 224

See application file for complete search history.

(56) References Cited

U.S. PATENT DOCUMENTS 1,350,237 A * 8/1920 Porter ..... G09B 23/24 190/13 H
2,329,520 A * 9/1943 Duberstein ..... B01L 7/02 126/220

(Continued)

*Primary Examiner* — Jennifer Eleanore Novosad
(74) *Attorney, Agent, or Firm* — Perkins Coie LLP

(57) ABSTRACT

An ergonomic vial and tube rack is disclosed for retaining a plurality of vials or tubes containing fluid therein in inclined or vertical upright positions, features of which a mechanism for a variable incline angle; lid/cap receptacles positioned either on a shelf above the vial holders or inside the cover when in an open position; an ice or heat pack compartment or a sealed compartment underneath the vials and/or behind the vials for the limited temperature control; rack to rack pin-to-hole locators for stackability, ease of transportation, and storage; color-coding of vial racks for convenience and work-flow assistance; a transparent front panel or an opening in front of each vial receptacle for additional verification of reagent labels; a rack cover with rows of circular indentations, with or without a disposable lining, for use as shallow reaction dishes for qualitative or quantitative chemical assays, such as pH testing.

17 Claims, 6 Drawing Sheets

(56) References Cited

U.S. PATENT DOCUMENTS 3,778,232 A * 12/1973 McMorrow, Jr. ..... B01L 9/06 211/74
4,411,868 A * 10/1983 Noack ..... B01L 9/06 211/60.1
4,535,897 A * 8/1985 Remington ..... B25H 3/00 211/70.6
4,826,003 A * 5/1989 Levy ..... A61B 10/0096 206/223
4,932,533 A * 6/1990 Collier ..... A61B 10/0096 206/370
5,040,678 A * 8/1991 Lenmark, Sr. ..... B65D 81/107 206/204
5,271,520 A * 12/1993 McAfee ..... A01K 97/06 206/315.11
5,415,277 A * 5/1995 Berntsen ..... B65D 21/0212 206/144
5,456,360 A * 10/1995 Griffin ..... B01L 9/06 206/443
5,714,127 A * 2/1998 DeWitt ..... B01J 19/0046 422/130
5,823,363 A * 10/1998 Cassel ..... A61M 5/008 206/366
5,850,917 A * 12/1998 Denton ..... A61M 5/008 206/366
6,361,746 B1 * 3/2002 Wlodarski ..... B01L 7/00 200/500
6,640,981 B2 * 11/2003 Lafond ..... B01L 9/06 206/443
D484,989 S * 1/2004 Gebrian ..... D24/230
6,875,405 B1 * 4/2005 Mathus ..... B01L 9/06 206/446
7,232,038 B2 * 6/2007 Whitney ..... B01L 9/06 211/74
7,910,067 B2 * 3/2011 Knight ..... B01L 9/06 211/71.01
9,084,834 B1 * 7/2015 Meuchel ..... E05C 1/04
9,802,200 B2 * 10/2017 Taylor ..... B01L 9/06
2004/0197235 A1 * 10/2004 Sorensen ..... B01L 3/5025 422/400
2005/0186121 A1 * 8/2005 West ..... B01L 3/50853 422/400
2006/0037965 A1 * 2/2006 Hamaguchi ..... E05C 19/022 220/830
2007/0269347 A1 * 11/2007 Stanchfield ..... B01L 9/52 422/400
2008/0229849 A1 * 9/2008 Doebler ..... B01L 7/52 73/864.91
2010/0147784 A1 * 6/2010 Rivero ..... A61J 7/04 211/74
2012/0085181 A1 * 4/2012 Etzold ..... B01L 7/02 73/863.11
2012/0328489 A1 * 12/2012 Beese ..... B01L 9/543 422/526
2014/0231372 A1 * 8/2014 Mills ..... B44D 3/12 211/85.18
2016/0370267 A1 * 12/2016 Frisse ..... G01N 1/4077
2016/0376137 A1 * 12/2016 Bell ..... B67B 1/045 53/381.4
2017/0043346 A1 * 2/2017 Welch ..... A61B 5/15
2017/0361325 A1 * 12/2017 Kantor ..... B01L 9/06

* cited by examiner

CUSTOMIZABLE STACKABLE RACK FOR VIALS AND TEST TUBES

CROSS REFERENCE TO RELATED APPLICATION

This application claims benefit to U.S. provisional patent application Ser. No. 62/350,609, filed Jun. 15, 2016, which is incorporated herein in its entirety by this reference thereto.

FIELD

The invention relates to a customizable stackable rack for vials and test tubes. More particularly, the invention relates to a customizable stackable rack for vials and test tubes with limited static temperature control and capabilities to be used with an active peltier device for long duration temperature control.

BACKGROUND

Reagents that are used in various biological, chemical, and immunophenotyping protocols routinely followed in clinical and research scientific labs commonly represent reagent panels that are necessary for conducting specific tests. Such protocols usually consist of numerous small consecutive tasks that require the handling of each individual reagent vial or sample tube, opening it, placing a lid/cap somewhere, pipetting out a predetermined amount of fluid, closing the vial with a lid/cap, and placing the vial or tube back on a support rack or on a bench surface. These tasks are repetitive and can cause discomfort or strain; also, these tasks create the possibility of tipping over badly supported reagent vials and switching and/or misplacing reagent vial caps, which subsequently renders reagent vials contaminated and unusable.

These reagents usually need to be stored in refrigerated temperatures (2°-8° C.) to prolong the integrity of the contents but, because lab protocols are routinely performed on a lab bench at ambient room temperature, reagents must be taken out from cold storage for multiple hours daily, which has a negative impact on reagent stability. In some cases, reagents may function best at temperatures above ambient room temperature and would benefit from proximity to a heat source during testing.

SUMMARY

An ergonomic vial and tube rack is disclosed for retaining a plurality of vials or tubes containing fluid therein in inclined or vertical upright positions, features of which a mechanism for a variable incline angle; lid/cap receptacles positioned either on a shelf above the vial holders or inside the cover when in an open position; an ice or heat pack compartment or a sealed compartment underneath the vials and/or behind the vials for the limited static temperature control and a removed bottom configuration to allow placement of an active multiple temperature device to be inserted for long term temperature capabilities; rack to rack pin-to-hole locators for stackability, ease of transportation, and storage; color-coding of vial racks for convenience and work-flow assistance; a transparent front panel or an opening in front of each vial receptacle for additional verification of reagent labels; a rack cover with rows of circular indentations, with or without a disposable lining, for use as shallow reaction dishes for qualitative or quantitative chemical assays, such as pH testing.

DRAWINGS

DESCRIPTION

Figure 1:
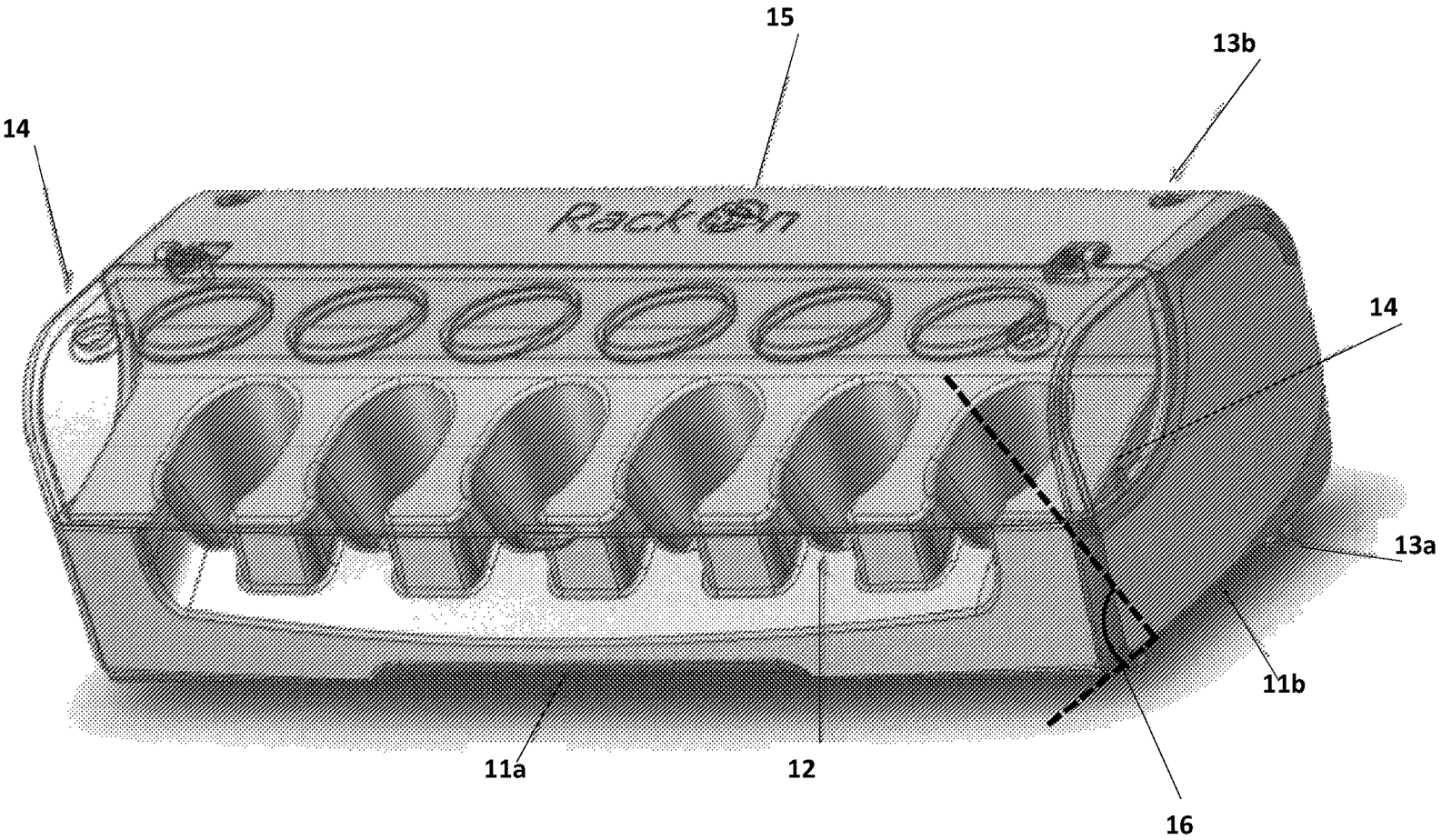
FIG. 1 is a front perspective view of a customizable stackable rack for vials and test tubes having a hinged top, showing the top in a closed position, according to the invention.

Embodiments of the invention comprise an ergonomic vial and tube rack (hereafter referred to as "rack") for retaining a plurality of vials or tubes containing fluid therein in inclined or vertical upright positions. The rack is a convenient work station that simplifies and minimizes the repetitious steps of various biological, chemical, and immunophenotyping protocols routinely used in clinical and research scientific labs, and also provides a measure of temperature and cross contamination control.

Embodiments of the invention comprise a streamlined rack for retaining a plurality of vials or sample tubes containing fluid therein in an inclined or vertical position, dependent on user requirements, with an additional customizable possibility of adjusting the angle of incline, if required. The configuration is optimized by the manufacturing of customer specific tube/vial dimensions and required angle for ease of use.

The rack consists of a plastic rectangular container which is divided into rows of compartments into which vials or sample tubes may be placed. The height of the rack, the number of compartments, and the diameters (or length and width of compartments) are variable and customizable. In embodiments of the invention, these variations are provided by the change in product insert used to hold vials and tubes.

The rack, in a closed position, is a plastic rectangular box with a horizontal or angled opening at the bottom or in the back to accommodate an ice or heat pack, or with a sealed compartment containing refrigerant gel therein, and additional features, such as, grooves and cut outs, or pin-to-hole locators, on the top and bottom to make it stackable.

The rack cover may contain indentations with, if needed, a disposable plastic lining for use as reaction or dipping dishes for quick qualitative or quantitative chemical reactions, for example, to measure pH or to dip a reagent color strip.

The rack, in an opened position, is a plastic box with an open cover, a checkerboard pattern of vial holders/compartments, and a shelf for vial caps/lids. The angle 16 at which the tops of the vials are accessed may be either fixed or may be adjusted by an optional mechanism, such as a rotating axle or stepped/slotted positioning mechanism. The tops of the vials may therefore be adjusted to required angles to facilitate the ease of use. Embodiments of the rack have tube holders in an inclined position that makes it possible to draw a pre-determined amount of reagent contained therein without ever taking the vial out of the rack, thus significantly reducing operator movements and using the dead volume in the vial. This is user and test specific. In embodiments of the invention, a molded insert may be used that is available in various sizes and configured to hold selected size vials or test tubes at a selected angle. In such embodiments, the user can order the desired inserts and place them in the rack or remove them and replace them with other inserts as appropriate.

The rack also includes indented receptacles into which the vial tops, e.g. caps, lids, etc., may be placed for temporary storage. In embodiments of the invention, these receptacles are situated in the rack cover. Any number of receptacles may be provided in the rack, e.g. six receptacles. Further, more than one row of receptacles may be provided, e.g. two rows of five receptacles. Also, the receptacles may all be of the same size or they may be of different sizes and/or adjustable to accommodate different size vials.

Most routinely used biological reagents are usually sensitive to light and temperature. Embodiments of the rack have a tinted cover to offer some protection from light exposure, in addition to the light control routinely provided by the amber or dark color of the vials.

Embodiments of the rack also have an ice or heat pack compartment in the bottom or in the back thereof which serves as a temporary temperature control measure to minimize the temperature switch from cold storage conditions to room temperature working conditions or an open bottom version to accommodate an active peltier device for constant and long duration temperature control.

Additionally, the vial racks are stackable to serve as reagent storage and thus minimize the space requirements on the bench, as well as in refrigerators or cold rooms. The ice packs, heating packs, or sealed gel can be regenerated to a refrigerated temperature by placing the rack back into a cold (2°-8° C.) environment.

The front panel of the rack has either a transparent panel or cut-outs to allow the user to make a clear, visual inspection of the labels of the vials/sample tubes within the rack.

FIG. 1 is a front perspective view of a customizable stackable rack for vials and test tubes having a hinged top, showing the top in a closed position, according to the invention.

In FIG. 1, ergonomically design and placed finger and hand hold features 11*a*, 11*b* are provided to make it easy for the user to pick up the vial rack and/or handle it.

Open vial viewing windows 12 allow the user to visually see the vial when the tinted lid is closed for storage and to read any labels or markings on the vial without opening the rack.

The vial racks are stackable for transportation and space saving storage, in an embodiment, using the molded rack feet 13*a* and recipient holes 13*b* molded into the rack body and tinted lid. Those skilled in the art will appreciate that other stacking arrangement may be used in connection with the herein disclosed invention.

Embodiments of the rack feature a tinted lid 14, which may be made of such materials as Lexan and the like. The lid rotates from a closed lock position to a full open position laying onto the vial rack body. In embodiments of the invention, the lid is tinted to protect stored vials from room or storage device lighting, which could adversely affect the product capability or stability. Embodiments of the invention provide a key or combination lock (not shown) for added security.

Embodiments of the rack 15 are made from such materials as a medical grade polycarbonate body, insert, and back cover. This allows the user to clean the rack with bleach or other required cleansing chemicals. Those skilled in the art will appreciate that other materials may be used to fabricate the herein disclosed rack.

Figure 2:
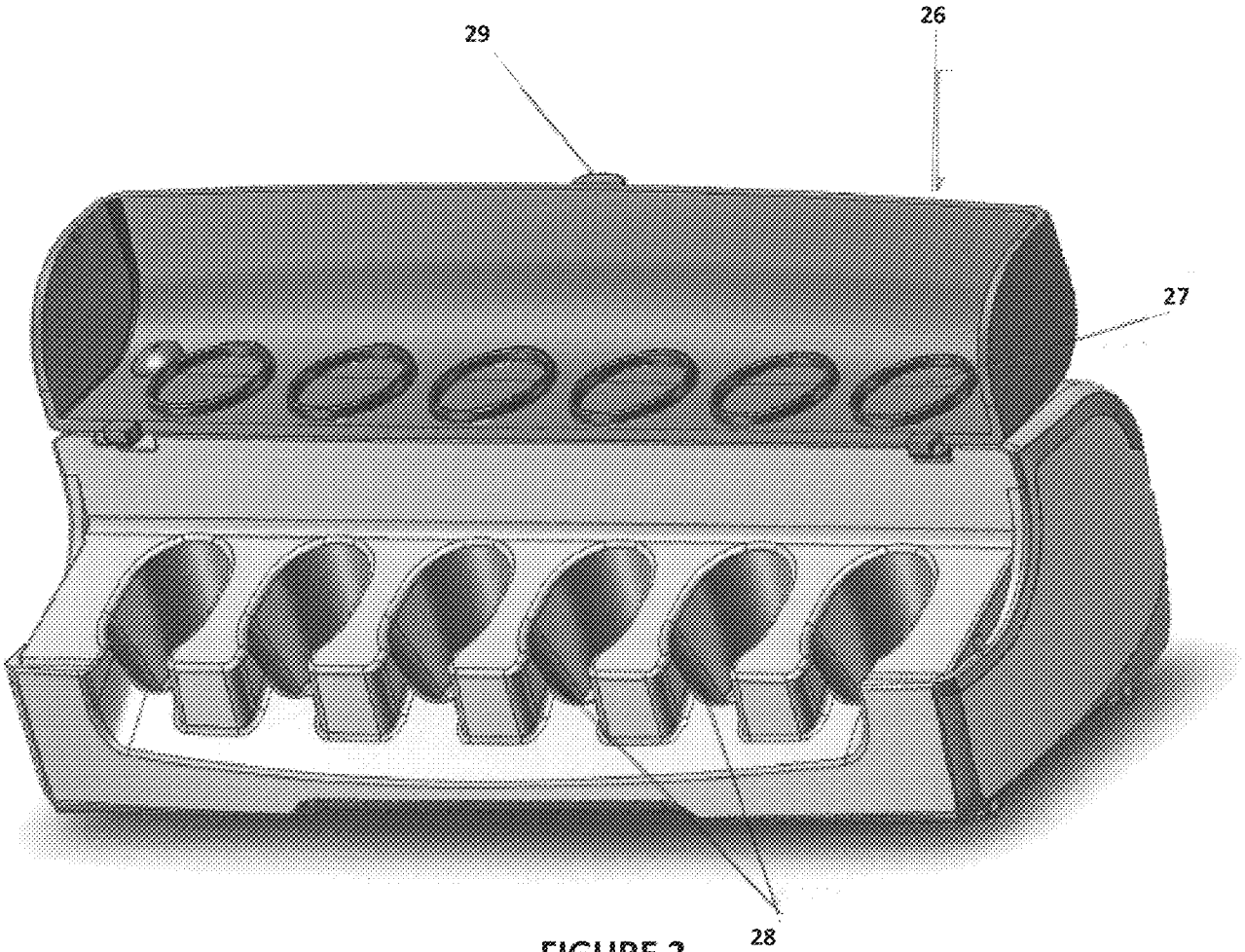
FIG. 2 is a front perspective view of a customizable stackable rack for vials and test tubes having a hinged top, showing the top in an opened position, according to the invention.

FIG. 2 is a front perspective view of a customizable stackable rack for vials and test tubes having a hinged top, showing the top in an opened position, according to the invention.

In FIG. 2, the tinted lid 26 is shown in a full, open position which allows the user to fully access the product.

The top lid features a plurality raised well receptacles 27 that are adjacent to corresponding vial wells. The well receptacles can be used for product cap storage while rack is open and in use, or they may be used as a sample preparation tray. In embodiments of the invention, the lid may be lockable.

When the product caps are placed in the lid receptacles, the lids are placed in an order the coincides with that of the vials, i.e. the caps are adjacent to and therefore associated with their corresponding vials. This avoids contamination that may result if the caps were mixed up and replaced on a vial other than that the cap was originally associated with.

Angled product barrel holders 28 provide an ergonomically correct insertion angle of a pipette by user, thus reducing wrist strain. The provision of angled vials allows the user to remove all content sufficiently by pipette and not leave any dead volume in the bottom of the vial.

The top lid features an easy lift tab 29 for opening and closing of the lid to the body of the rack.

Figure 3:
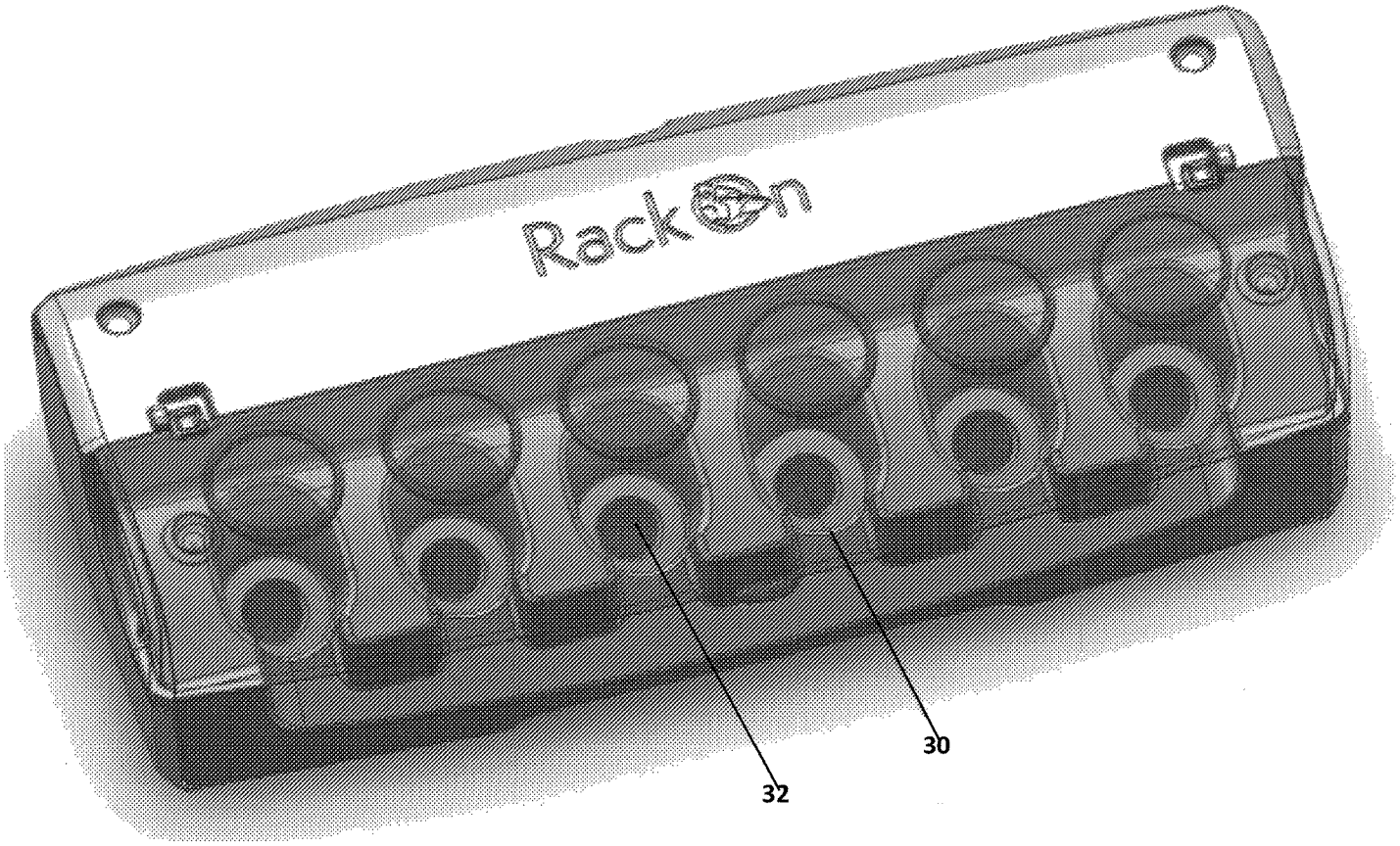
FIG. 3 is a top perspective view of a customizable stackable rack for vials and test tubes having a hinged top according to the invention.

FIG. 3 is a top perspective view of a customizable stackable rack for vials and test tubes having a hinged top according to the invention.

FIG. 3 shows open bottom barrels 30 for vial storage and usage. Openings 32 in the barrels allow moderation and maintenance of the temperature of inserted/enclosed media within the rack and provide an easy path to temper the vials. The open bottom also allows thorough cleaning of the barrels and the rack.

Figure 4:
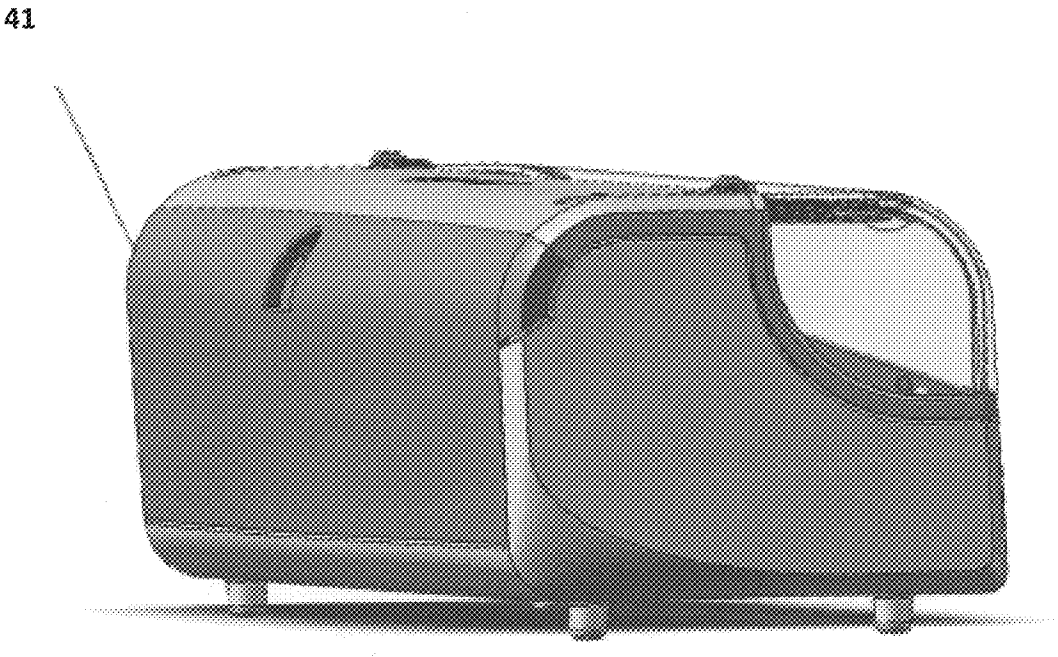
FIG. 4 is a rear perspective view of a customizable stackable rack for vials and test tubes having a hinged top, showing a rear cover in a closed position, according to the invention.

FIG. 4 is a rear perspective view of a customizable stackable rack for vials and test tubes having a hinged top, showing a rear cover in a closed position, according to the invention.

FIG. 4 shows a closed and removable back cover 41. This cover allows user easy access to insert and remove tempered media devices (gel packs) and close for secure holding of such media. In other embodiments of the invention, the removable cover may be located on the side or bottom of the rack.

Figure 5:
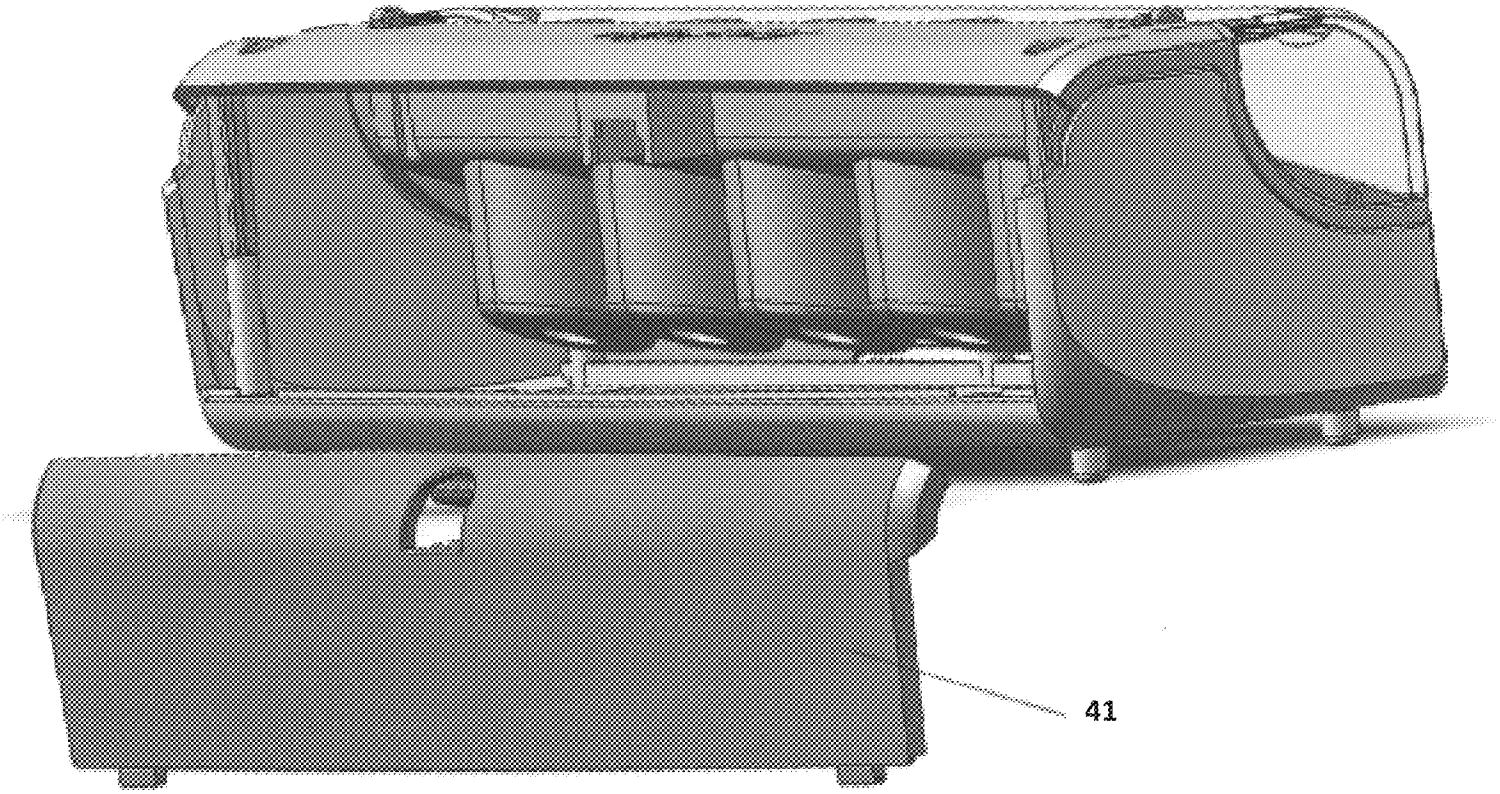
FIG. 5 is a rear perspective view of a customizable stackable rack for vials and test tubes having a hinged top, showing a rear cover in an open position, according to the invention.

FIG. 5 is a rear perspective view of a customizable stackable rack for vials and test tubes having a hinged top, showing the rear cover in an open position, according to the invention. It can be seen that a user may readily insert a tempered media device in the rack and that the device readily cools or heats the barrels and, accordingly, the vials within the rack. Those skilled in the art will appreciate that any manner of heating or cooling medium may be used. A particular advantage of this feature of the invention is that when the tempered media device is used the reagents within the vials are maintained at a preferred temperature in connection with the rack for few hours that is sufficient to carry out routine lab protocol As such, results obtained from tests performed with the reagents are more consistent and reliable.

In embodiment of the rack where pelteir device is used the desired temperature is maintained for as long as the customer requires.

Figure 6:
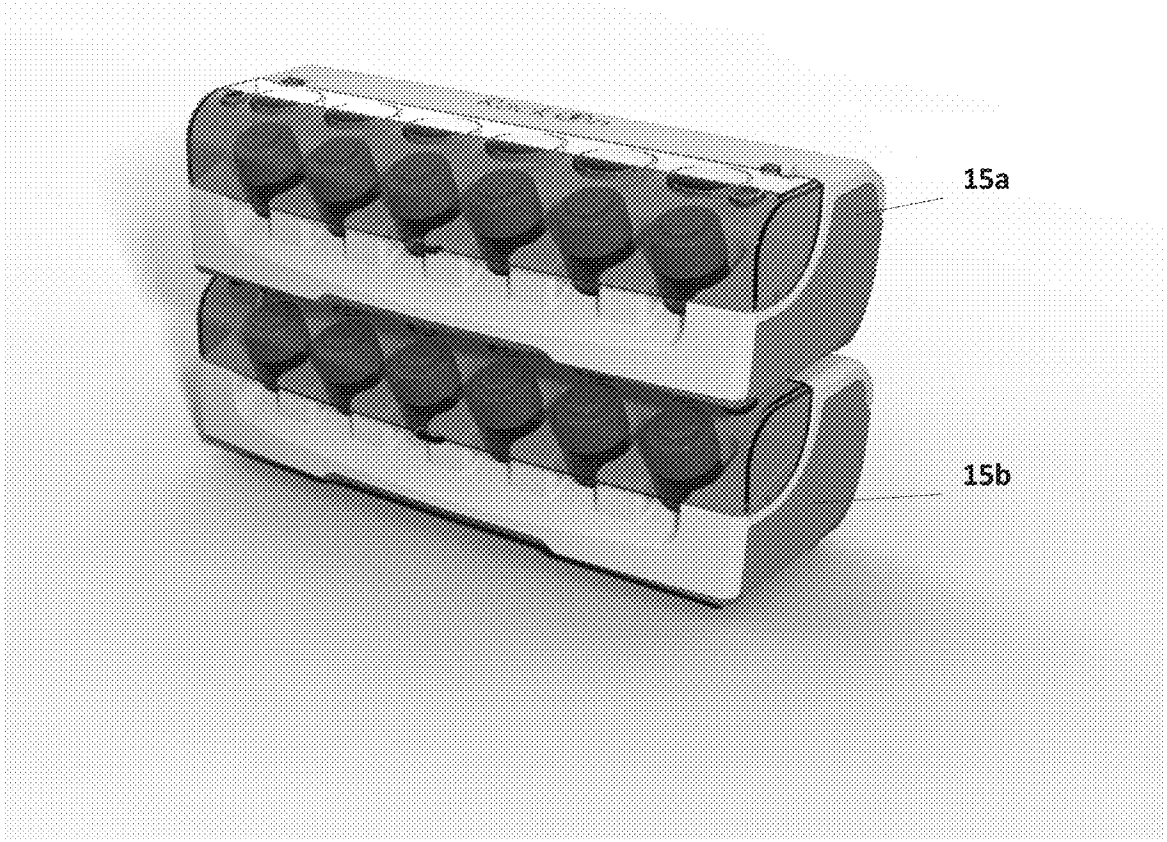
FIG. 6 is a front perspective view showing two racks in a stacked configuration according to the invention.

FIG. 6 is a front perspective view showing two racks 15*a*, 15*b* in a stacked configuration according to the invention.

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

The invention claimed is:

1. A container rack, comprising:

a base enclosing a volume;

a plurality of elongate, curved depressions formed within said base, each of said depressions defining a wall extending within said volume that separates an area surrounded by said depressions from said volume, said depressions substantially proportioned and configured to receive and at least partially retain a container therein;

a lid movably associated with said base, said lid positionable in a first, closed location proximate to said depressions that substantially covers and encloses each of said depressions and a second, opened location;

a row of substantially circular indentations formed within said lid, each indentation positioned adjacent to a corresponding depression, said indentations formed on an inner surface of said lid when said lid is in said first, closed location, and each indentation configured to receive any of a container cap and a reagent when said lid is in said second, opened location;

an opening within said base for access to said volume for receiving at least one tempered medium device for placement within said volume proximate to the wall of each of said depressions for thermal conduction between said depressions and said at least one tempered medium device when said at least one tempered medium device is placed within said volume; and said base comprising a removable cover for said opening.

2. The container rack of claim 1, further comprising:

at least one depression within an exterior surface of said base to provide a hand or finger grip.

3. The container rack of claim 1, further comprising:

complementary locators in any of respective top and bottom surfaces of said base for secure stacking of two or more container racks.

4. The container rack of claim 1, wherein said lid is formed of a tinted material.

5. The container rack of claim 1, wherein said lid is pivotable between said first, closed location to cover and enclose said depressions and said second, open location to provide access to said depressions.

6. The container rack of claim 1, further comprising:

said plurality of depressions arranged in a row adjacent to each other.

7. The container rack of claim 1, further comprising:

said opening within said base formed in any of a side, a rear, or bottom portion of said base.

8. The container rack of claim 1, said lid further comprising:

a lift tab.

9. The container rack of claim 1, further comprising:

an opening formed in a bottom portion of at least one of said depressions and in communication with said volume.

10. The container rack of claim 1, further comprising:

an opening formed in a bottom portion of at least one of said depressions and in communication with an exterior of said base.

11. The container rack of claim 1, further comprising:

said depressions having a vertical axis that is at an angle relative to a vertical axis of said base.

12. The container rack of claim 1, wherein at least some of said depressions have different dimensions.

13. The container rack of claim 1, wherein said lid further comprises a lock.

14. The container rack of claim 1, wherein said lid is substantially transparent.

15. The container rack of claim 1, wherein said lid further comprises a plurality of openings or transparent portions proximate to each depression for visual inspection of containers placed within each said depression when said lid is in the first, closed location.

16. The container rack of claim 1, further comprising:

a shelf positioned inwardly adjacent and along said depressions, said shelf comprising a row of substantially circular indentations formed therein, each indentation positioned adjacent to a corresponding depression, wherein each indentation is configured to receive any of a container cap and a reagent.

17. The container rack of claim 1, where said plurality of elongate, curved depressions are formed in a molded insert that is removably positionable within said base.

* * * * *